US006954028B2

(12) United States Patent
Rho

(10) Patent No.: US 6,954,028 B2
(45) Date of Patent: Oct. 11, 2005

(54) SCREEN FOR CATHODE RAY TUBE AND METHOD FOR MANUFACTURING THE SAME

(75) Inventor: Hwan-Chul Rho, Busan Metropolitan (KR)

(73) Assignee: Samsung SDI, Co., Ltd., Suwon-si (KR)

( * ) Notice: Subject to any disclaimer, the term of this patent is extended or adjusted under 35 U.S.C. 154(b) by 392 days.

(21) Appl. No.: 10/172,512

(22) Filed: Jun. 17, 2002

(65) Prior Publication Data

US 2003/0006691 A1 Jan. 9, 2003

(30) Foreign Application Priority Data

Jul. 6, 2001 (KR) ..... 2001-40469

(51) Int. Cl.[7] ..... H01J 29/28
(52) U.S. Cl. ..... 313/461; 313/477 R
(58) Field of Search ..... 313/460–465, 313/473, 477 R, 479, 476, 408, 466; 348/823, 824

(56) References Cited

U.S. PATENT DOCUMENTS 4,039,701 A * 8/1977 Benthem et al. ..... 427/69
4,626,739 A * 12/1986 Shmulovich ..... 313/469
4,801,842 A * 1/1989 Compen ..... 313/402
4,806,823 A * 2/1989 Compen et al. ..... 313/479
5,083,057 A * 1/1992 Kim ..... 313/479
5,151,337 A * 9/1992 Wetzel et al. ..... 430/28
5,173,636 A * 12/1992 Son ..... 313/466
5,602,442 A * 2/1997 Jeong ..... 313/466

* cited by examiner

*Primary Examiner*—Joseph Williams
*Assistant Examiner*—Dalei Dong
(74) *Attorney, Agent, or Firm*—Robert E. Bushnell, Esq.

(57) ABSTRACT

A screen for a cathode ray tube and a method for manufacturing the screen are provided. The screen for a cathode ray tube includes: a phosphor film formed on the inner front surface of a panel where at least one stud pin is mounted, the phosphor film including phosphor layers; a metal layer formed on the phosphor film, which reflects light emitted from the phosphor layers toward the front side of the panel; and a gas exhaust member extended from the metal layer, which provides a path for gas to exhaust, the gas being generated as a filming layer interposed between the phosphor film and the metal layer to make the thickness of the phosphor film uniform is decomposed. To manufacture this screen, a guide block having a mask pattern, which corresponds to a pattern of a metal layer and gas exhaust member to be formed as a single body inside the panel on which the phosphor film and a filming layer have been formed, is fitted into the panel. After evacuating a processing space where the panel is loaded, a precursor of the metal layer is heated to evaporate, thereby simultaneously forming the metal layer on the filming layer to cover the phosphor film and forming the gas exhaust member to selectively extend from the boundary of the metal layer as a pattern.

20 Claims, 5 Drawing Sheets

SCREEN FOR CATHODE RAY TUBE AND METHOD FOR MANUFACTURING THE SAME

CLAIM OF PRIORITY

This application makes reference to, incorporates the same herein, and claims all benefits accruing under 35 U.S.C. §119 from an application for FLUORESCENT SCREEN FOR CATHODE RAY TUBE AND THE FABRICATION METHOD THEREOF earlier filed in the Korean Industrial Property Office on 6 Jul. 2001 and there duly assigned Serial No. 40469/2001.

BACKGROUND OF THE INVENTION

1. Field of the Invention

The present invention relates to cathode ray tubes, and more particularly, to a screen for a cathode ray tube, capable of preventing a metal layer, which is formed on a phosphor film coated inside a panel, from expanding and being separated from the underlying layer during a thermal process, and a method for manufacturing the screen.

2. Description of the Related Art

In general, a cathode ray tube (CRT) displays an image by excitation of red, green, and blue phosphors of a phosphor film coated inside a panel by electron beams emitted by an electron gun and passed through electron beam apertures of a shadow mask mounted in the bulb structure formed by the panel and a funnel.

On the inner front surface of a panel, a phosphor film including a black matrix layer and red, green, and blue (RGB) phosphor layer, which are alternately formed as strips, is formed. A metal layer, for example, an aluminum layer, is formed on the phosphor film.

Briefly, a method for manufacturing a screen for the CRT having the structure described above will be described. After cleaning the panel, the black matrix layer and the RGB phosphor layer are sequentially formed inside the panel. Subsequently, a filming layer is formed using an organic material to make the surface of the RGB phosphor layer even. To improve the luminance of the phosphor film and facilitate the emission of excess electrons in the bulb, the aluminum layer is deposited in a vacuum by thermal diffusion.

Next, the filming layer is calcinated so that the organic material is thermally decomposed, emitting gas into the air. This is for preventing energy loss as an electron beam emitted from the electron gun hits the filming layer before landing on the phosphor layer. Formation of the screen inside the panel is complete through a series of processes described above.

In the conventional CRT, the aluminum layer is formed over the entire inner region of the panel to completely cover the phosphor film. This structure has the following problems.

As described above, in forming the filming layer between the fluorescent layer and the aluminum layer to make up fine recessions or air gaps in the phosphor layer, an organic material such as an aqueous emulsion of acrylic resin is evenly spin coated on the phosphor film. The filming layer is removed by means of calcination after the aluminum layer is deposited thereon.

In the deposition of the filming layer inside the panel, it is difficult to evenly control the thickness of the filming layer. It is common that the filming layer is thicker at the edge of the panel, particularly at the corners, than the other inner region of the panel. As a result, a large amount of gas is generated from the relatively thicker region of the filming layer as it thermally decomposes during the calcinations process.

Also, the aluminum layer deposited on the filming layer expands and is separated from the panel while another process is performed or the CRT is operated, so that particles of the aluminum layer block the electron beam apertures up. As the aluminum layer expands, irregular reflection of light occurs at the screen, thereby lowering the luminance of the CRT.

SUMMARY OF THE INVENTION

To solve the above-described and other problems, it is an object of the present invention to provide a screen for a cathode ray tube and a method for manufacturing the same, in which a gas exhaust member is selectively formed on the boundary of a metal layer formed on a phosphor film inside a panel to prevent the metal layer from expanding during a thermal process.

It is another object to provide a technique and an apparatus for a cathode ray tube that accommodates for light emitted from the phosphor layer to be uniformly reflected toward the front surface of the panel.

It is still another object to provide a technique and an apparatus for a cathode ray tube that improves the luminance in the cathode ray tube.

To achieve the above and other objects of the present invention, there is provided a screen for a cathode ray tube, including: a phosphor film formed on the inner front surface of a panel where at least one stud pin is mounted, the phosphor film including phosphor layers; a metal layer formed on the phosphor film, which reflects light emitted from the phosphor layers toward the front side of the panel; and a gas exhaust member extended from the metal layer, which provides a path for gas to exhaust, the gas being generated as a filming layer, interposed between the phosphor film and the metal layer to make the thickness of the phosphor film uniform, is decomposed.

It is preferable that the gas exhaust member is formed along the boundary of the metal layer in the inner front surface of the panel, except for the corners of the panel.

It is preferable that the gas exhaust member is selectively formed on the boundary of the metal layer in the inner front surface of the panel such that at least one recession along the side edges of the panel is exposed.

It is preferable that the gas exhaust member is selectively formed on the boundary of the metal layer such that the corners of the panel and at least one recession along the side edges of the panel are exposed.

It is preferable that the gas exhaust member additionally extends to the inner sidewall of the panel from the boundary of the metal layer, except for a region where the stud pin is positioned.

To further achieve the above and other objects of the present invention, there is also provided a method for manufacturing a screen for a cathode ray tube, the method includes: forming a phosphor film on the inner front surface of a panel; forming a filming layer of an organic material on the phosphor film; fitting a guide block into the panel and evacuating a processing space where the panel is loaded, the guide block having a mask pattern corresponding to a pattern of a metal layer and gas exhaust member to be formed as a single body inside the panel; on the filming layer, simultaneously forming the metal layer to cover the phosphor film and forming the gas exhaust member to selectively extend from the boundary of the metal layer as a pattern, by heating a precursor of the metal layer to evaporate, the gas exhaust member providing a path for gas generated during decomposition of the filming layer to exhaust; restoring the processing space to normal pressure; and thermally processing the panel to decompose and remove the filming layer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
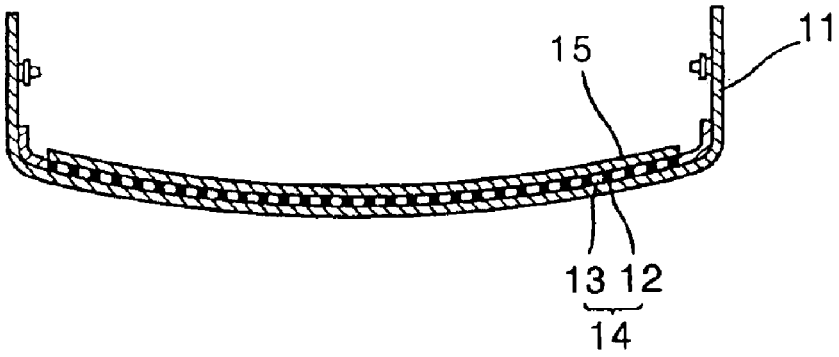
FIG. 1 is a sectional view showing a conventional screen having a metal layer on a panel.

As shown in FIG. 1, on the inner front surface of a panel 11, a phosphor film 14 including a black matrix layer 12 and red, green, and blue (RGB) phosphor layer 13, which are alternately formed as strips, is formed. A metal layer, for example, an aluminum layer 15, is formed on the phosphor film 14.

Briefly, a method for manufacturing a screen for the CRT having the structure described above will be described. After cleaning the panel 11, the black matrix layer 12 and the RGB phosphor layer 13 are sequentially formed inside the panel 11. Subsequently, a filming layer is formed using an organic material to make the surface of the RGB phosphor layer 13 even. To improve the luminance of the phosphor film 14 and facilitate the emission of excess electrons in the bulb, the aluminum layer 15 is deposited in a vacuum by thermal diffusion.

Next, the filming layer is calcinated so that the organic material is thermally decomposed, emitting gas into the air. This is for preventing energy loss as an electron beam emitted from the electron gun hits the filming layer before landing on the phosphor layer 13. Formation of the screen inside the panel is complete through a series of processes described above.

Figure 2:
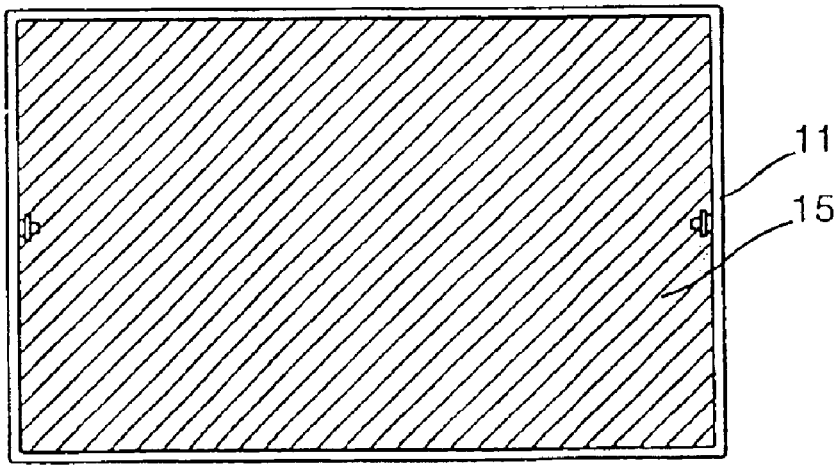
FIG. 2 (PRIOR ART)
FIG. 2 is a plan view of the conventional screen of FIG. 1.

As shown in FIG. 2, in the conventional CRT, the aluminum layer 15 is formed over the entire inner region of the panel 11 to completely cover the phosphor film 14. This structure has the following problems.

As described above, in forming the filming layer between the fluorescent layer 14 and the aluminum layer 15 to make up fine recessions or air gaps in the phosphor layer 13, an organic material such as an aqueous emulsion of acrylic resin is evenly spin coated on the phosphor film 14. The filming layer is removed by means of calcination after the aluminum layer 15 is deposited thereon.

In the deposition of the filming layer inside the panel 11, it is difficult to evenly control the thickness of the filming layer. It is common that the filming layer is thicker at the edge of the panel 11, particularly at the corners, than the other inner region of the panel 11. As a result, a large amount of gas is generated from the relatively thicker region of the filming layer as it thermally decomposes during the calcinations process.

Also, the aluminum layer 15 deposited on the filming layer expands and is separated from the panel while another process is performed or the CRT is operated, so that particles of the aluminum layer 15 block the electron beam apertures up. As the aluminum layer 15 expands, irregular reflection of light occurs at the screen, thereby lowering the luminance of the CRT.

Figure 3:
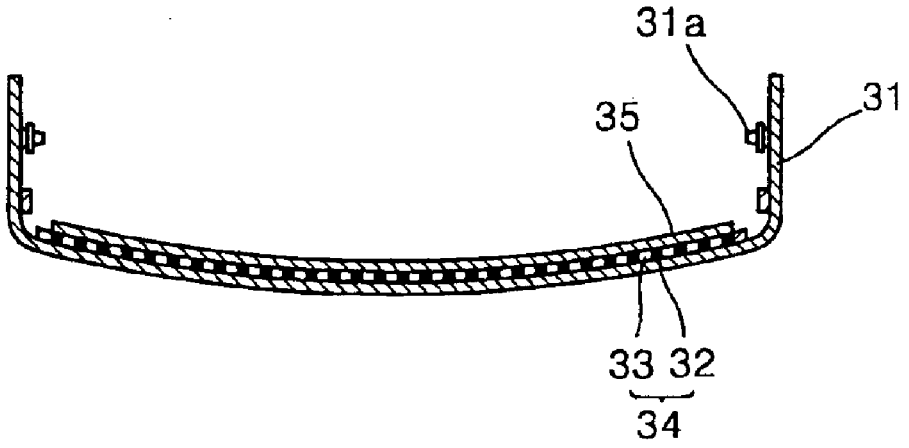
FIG. 3 is a sectional view showing a first embodiment of a screen for a cathode ray tube according to the present invention in which a metal layer formed on a panel is shown.

A sectional view of a first embodiment of a screen for a cathode ray tube according to a first embodiment of the present invention is shown in FIG. 3. Referring to FIG. 3, a phosphor film 34 is formed on the inner front surface of a panel 31, and a metal layer, for example, an aluminum layer 35, is deposited on the phosphor film 34.

The phosphor film 34 includes a black matrix layer 32 formed inside the panel 31 as strips spaced a predetermined distance apart and a phosphor layer 33 of red, green, and blue phosphors, which are alternatively interposed between each of the strips of the black matrix layer 32. To prevent color purity degradation by successive emission of adjacent phosphors, the black matrix layer 32 is formed of a non-luminescent, light-absorbing material, such as graphite.

The aluminum layer 35 is deposited on the phosphor film 34. The aluminum layer 35 reflects a scanning electron beam diverging by hitting the fluorescent layer 33 after having been emitted by an electron gun (not shown), toward the front side of the panel 31, thereby improving the luminance. The aluminum layer 35 acts to enhance the potential for the screen by guiding the flow of electrons hitting the phosphor layer 33, which is an insulating layer, out of the phosphor layer 33 to prevent a potential drop therein. To end this, the aluminum layer 35 is electrically connected to a stud pin 31*a* in a subsequent process, which is formed inside the panel 31 using a conductive material such as graphite. As a result, once electrons reach the screen, the electrons can migrate to the anode through the aluminum layer 35, the stud pin 31*a*, a shadow mask assembly, an electron shield, and then an interior graphite layer.

A feature of the present invention lies in that a gas exhaust member is formed as an extension of the aluminum layer 35.

Figure 4:
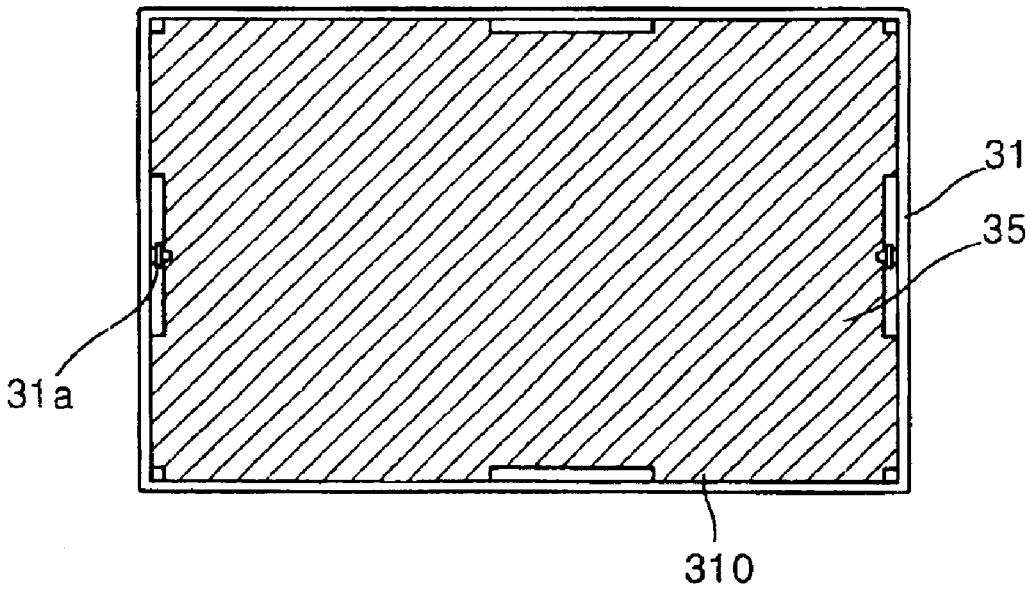
FIG. 4 is a plan view of the screen of FIG. 3.
Figure 5:
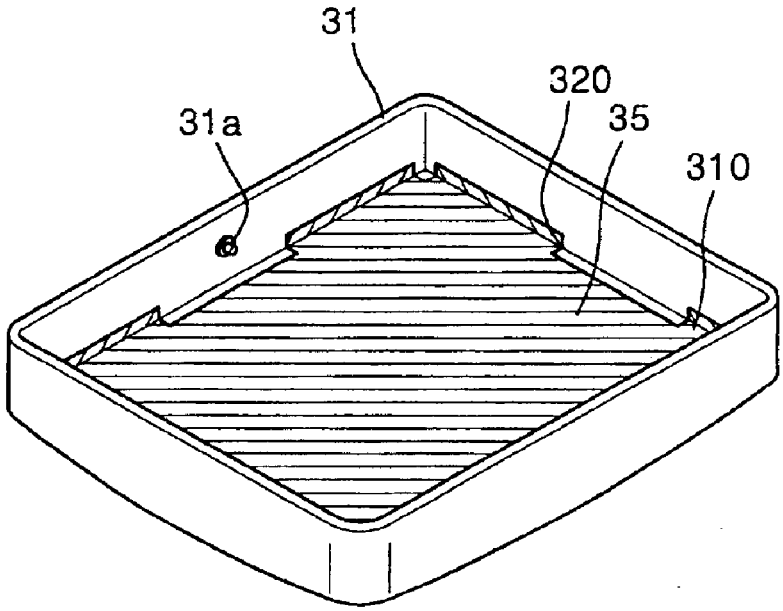
FIG. 5 is a perspective view of the screen of FIG. 4.

FIG. 4 is a plan view of the screen of FIG. 3, and FIG. 5 is a perspective view of the screen of FIG. 3. Referring to FIGS. 4 and 5, the aluminum layer 35 is deposited on the phosphor film 34 (see FIG. 3), which is formed as an image forming layer on the inner front surface of the panel 31.

Gas exhaust members are formed inside the panel 31. In particular, the aluminum layer 35 is formed to completely cover the phosphor film 34. A first gas exhaust member 310 is selectively formed on the boundary of the aluminum layer 35. A second gas exhaust member 320 is formed on the inner sidewall of the panel 31, extending from the first gas exhaust member 320. The first and second gas exhaust members 310 and 320 are formed of substantially the same material and at the same time as the aluminum layer 35 by vacuum deposition.

In detail, in the manufacture of a screen, an intermediate filming layer is formed of an organic material on the phosphor film 34 to make the surface of the phosphor layer 32 even. However, the filming layer deposited on the phosphor film 34 has a localized thickness variation. As a result, when the organic material of the filming layer is thermally decomposed and vaporized during a subsequent calcination process following deposition of the aluminum layer 35 thereon, a large amount of gas is generated from the relatively thicker region of the filming layer so that the aluminum layer 35 expands much at the thicker region. To prevent this phenomenon, according to the present invention, the aluminum layer 35 is not deposited on the region of the filming layer having a relatively large thickness.

To end this, after the aluminum layer 35 is formed to completely cover the phosphor film 34, gas exhaust members are selectively formed on the boundary of the aluminum layer 35. In particular, at the corners or at the long-side and/or short-side edges of the panel 31, an aluminum layer is not formed such that gas generated during removal of the filming layer easily exhausts. Meanwhile, the first gas exhaust member 310 is formed along the remaining edge region, extending from the aluminum layer 25, thereby resulting in an uneven pattern along the boundary of the aluminum layer 25.

On the inner sidewall of the panel 31, the second gas exhaust member 320 is selectively formed, extending from the first gas exhaust member 310. One end of the second gas exhaust member 320 is connected to the stud pin 31*a* by a conductive material such as graphite.

An example of the process of manufacturing the screen having the structure described above will be described.

After cleaning the inner surface of the panel 31, the black matrix layer 32 is formed on the inner front surface of the panel 31. The black matrix layer 32 is formed as strips by means of photoresist deposition, exposure, development, graphite deposition, and etching processes.

The phosphor layer 33 is formed between the strips of the black matrix layer 32 by a precipitation, photolithography, or slurry method, but the slurry method is widely used. The phosphor layer 33 is spin coated on the inner surface of the panel 31, dried using an infrared heater, exposed to an ultra high vacuum mercury lamp while a shadow mask is fit into the bulb, and developed using water, thereby forming a phosphor pattern. By repeating these processes for R, G, B phosphors, a RGB phosphor pattern is formed. As a result, the formation of the phosphor film 34 is complete.

Next, to make the surface of the phosphor layer 33 even, an organic material is deposited on the entire surface of the phosphor film 34 to form the filming layer. After formation of the filming layer is complete, a metal layer having a high reflectivity, for example, the aluminum layer 35, is deposited on the filming layer.

Figure 6:
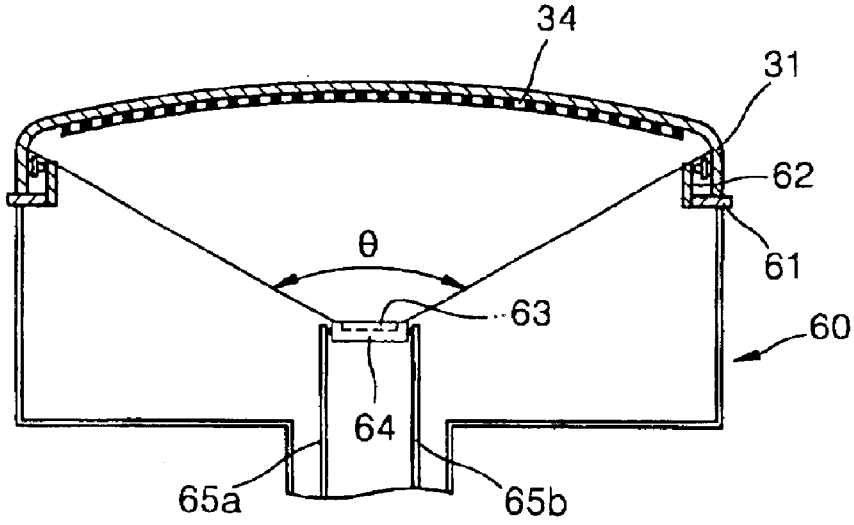
FIG. 6 illustrates a panel of FIG. 3 coupled to an apparatus to form a metal layer and a gas exhaust member on the panel.
Figure 7:
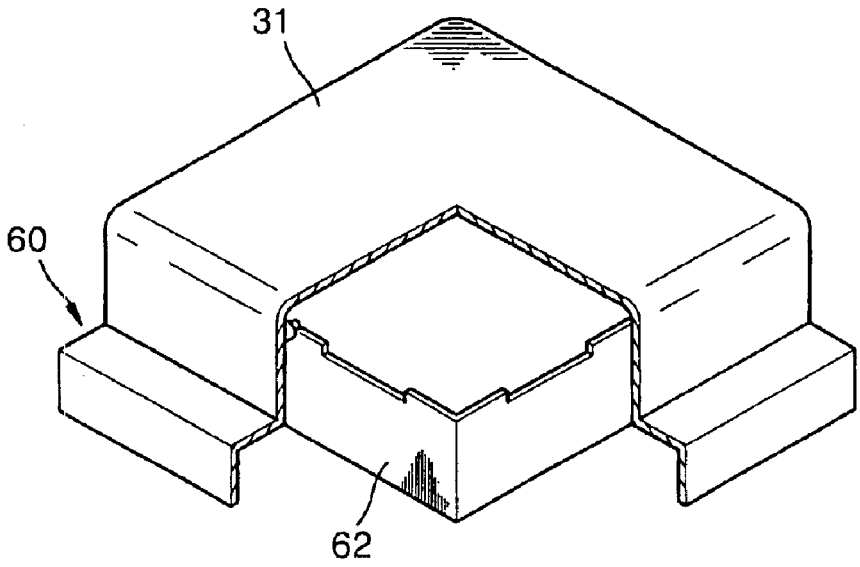
FIG. 7 is a partially cutaway perspective view of FIG. 6.
Figure 8:
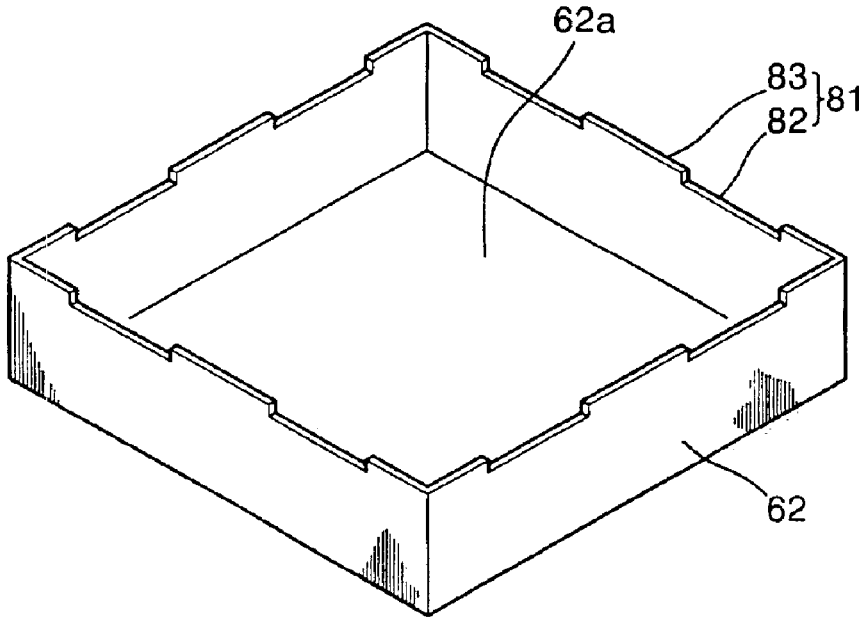
FIG. 8 is a perspective view of a guide block of FIG. 7.

The aluminum layer 35 is deposited using a vacuum deposition apparatus, as shown in FIGS. 6 and 7. In particular, the panel 31 is coupled to the vacuum deposition apparatus 60. When the vacuum deposition apparatus 60 is applied to deposit the aluminum layer 35, intermolecular bombardment of aluminum is less likely to occur and thus, improving the evaporation rate of aluminum. Also, the vacuum condition, which almost free from oxygen or nitrogen, prevents oxidation and nitrification reactions from taking place therein.

The panel 31 is tightly sealed from the outside by a seal member 61 mounted at the binding site between the panel 31 and the vacuum evaporation apparatus 60. A guide block 62 having a mask pattern corresponding to the pattern of the aluminum layer 35 and the gas exhaust members to be deposited on the panel 31 is attached to the seal member 61. A boat 64, in which an aluminum pellet 63 as a source material of the aluminum layer 35 is contained, is located below the guide block 62. Both ends of the boat 64 are electrically connected to a positive electrode rod 65*a* and a negative electrode rod 65*b*, respectively, each having a predetermined length.

The vacuum deposition apparatus 60 having the configuration described above is pre-evacuated using a rotary pump and then evacuated to an ultra high vacuum using a diffusion pump, not to exceed a critical vacuum level.

The boat 64 is heated by applying a predetermined power across the positive and negative electrode rods 65*a* and 65*b*. As the boat 64 is heated, the aluminum pellet 63 contained in the boat 64 melts and the aluminum molecules start to evaporate. The aluminum molecules thermally diffuse at an angle of θ toward the inner front surface of the panel 31 on which the phosphor film 34 has been formed, thereby forming the aluminum layer 35 and the gas exhaust members as a predetermined pattern.

The guide block 62 having a mask pattern for the aluminum layer 35 and the gas exhaust members to be deposited is fit into the panel 31. The guide block 62 is formed as a rectangular frame having a center hole 62*a*. The guide block 62 has a recession and projection portion 81 along one edge facing the panel 31, which has a pattern corresponding to the pattern of the gas exhaust members.

As aluminum molecules evaporate and diffuses through the center hole 62*a* of the guide block 62, the aluminum layer 35 (see FIG. 5) is deposited on the inner front surface of the panel 31. The first and second gas exhaust members 310 and 320 are formed as a predetermined pattern on the edge of the inner front surface and the inner sidewall of the panel 31 as the evaporated aluminum molecules diffuse into the recession 82 of the guide block 62. The diffusion of the vaporized aluminum molecules is blocked by the projection 83 of the guide block 62, so that the first gas exhaust member 310 is not formed at an edge region of the panel 31 covered by the projection 83.

As a result, the first and second gas exhaust members of a recession and projection pattern are formed along the edge of the inner front surface of the panel 31. By blocking a region of the inner front surface of the panel 31, where the filming layer is formed to be thick, with the guide block 62, the first and second gas exhaust members 310 and 320 are not formed at the relatively thick region of the inner front surface.

After deposition of the aluminum layer 35 and the first and second gas exhaust members as a predetermined pattern is complete, the panel 31 is calcinated. The filming layer is thermally decomposed during calcination and removed from the screen.

Through the processes described above, the phosphor film 34, the aluminum layer 35, and the first and second gas exhaust members 310 and 320 are completely formed on the inner front surface of the panel 31.

Figure 9:
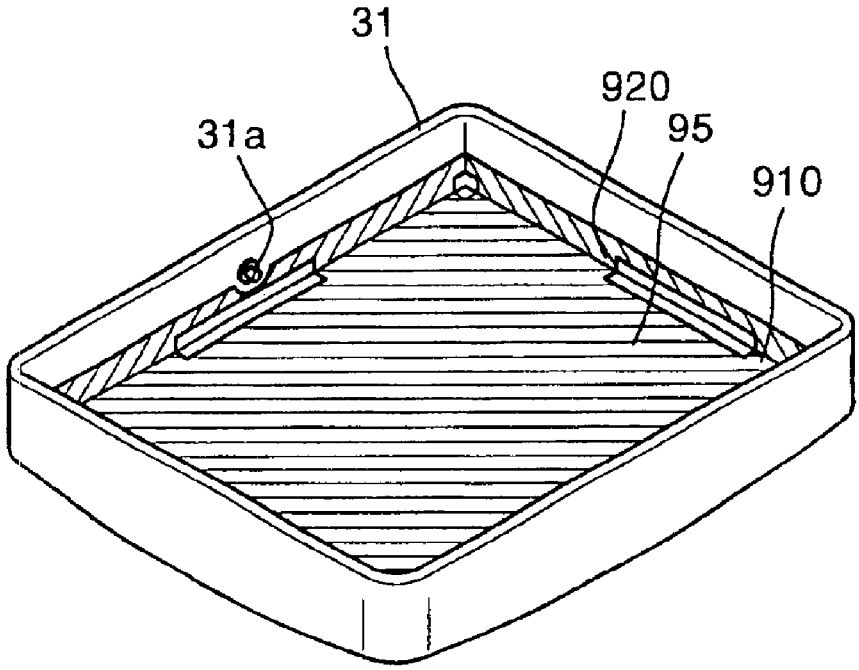
FIG. 9 is a perspective view showing a second embodiment of the screen according to the present invention in which a metal layer and gas exhaust members formed on the panel are shown.

FIG. 9 is a perspective view of a second embodiment of the screen according to the present invention. In this embodiment, only features of the screen will be described.

Referring to FIG. 9, a phosphor film (not shown), as described above, is formed on the inner front surface of the panel 31, and an aluminum layer 95 is formed as a predetermined pattern to cover the phosphor film. A first gas exhaust member 910 is selectively formed on the boundary of the aluminum layer 95, and a second gas exhaust member 920 is formed on the inner sidewall of the panel 31.

The first gas exhaust member 910 extends from the aluminum layer 95. Also, the first gas exhaust member 910 is formed to protrude from the boundary of the aluminum layer 95. The first gas exhaust member 910 is selectively formed on the edge of the inner front surface of the panel 31.

The second gas exhaust member 920 is formed on the inner sidewall of the panel 31, extending from the first gas exhaust member 910. Unlike the first embodiment described above, the second gas exhaust member 920 is deposited on the inner sidewall of the panel 31, extending to a height at which the stud pin 31 is positioned. The second gas exhaust member 920 is not deposited near the stud pin 31*a*. The second gas exhaust member 920 may be not formed in a region of the inner sidewall of the panel 31 adjacent to the region where the first gas exhaust member 910 is not formed. The area of deposition in the panel 31 is increased by the first and second gas exhaust members 910 and 920 formed as extending from the aluminum layer 95, so that the potential of the screen is increased.

The screen for a CRT and the method for manufacturing the same according to the present invention described above provide the following effects.

The gas exhaust member is formed as an extension of the metal layer formed on the phosphor film in the inner front surface of a panel, extending from the boundary of the metal layer as a predetermined pattern. As a result, in removing the filming layer interposed between the phosphor layer and the metal layer to manufacture a screen, expansion of the metal layer due to the non-uniform thickness of the filming layer can be prevented so that light emitted from the phosphor layer can be uniformly reflected toward the front surface of the panel, thereby improving the luminance of the CRT.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A screen for a cathode ray tube, comprising:

a phosphor film formed on an inner front surface of a panel where at least one stud pin is mounted, said phosphor film including phosphor layers;

a metal layer formed on said phosphor film, reflecting light emitted from said phosphor layers toward a front side of said panel; and a gas exhaust member extended from said metal layer, providing a path for gas to exhaust, the gas being generated as a filming layer, interposed between said phosphor film and said metal layer to make the thickness of said phosphor film uniform, is decomposed, said gas exhaust member disposed according to a thickness of the filming layer, the gas exhaust member formed along an edge of the inner front surface of said panel and not formed at regions of a certain thickness of the inner front surface of said panel.

2. The screen of claim 1, wherein said gas exhaust member is selectively formed on the boundary of said metal layer in said inner front surface of said panel where at least one recession along the side edges of said panel is exposed.

3. The screen of claim 2, wherein said gas exhaust member additionally extends to said inner sidewall of said panel from the boundary of said metal layer, except for a region where said stud pin is positioned.

4. The screen of claim 1, wherein said gas exhaust member is selectively formed on the boundary of said metal layer where the corners of said panel and at least one recession along the side edges of said panel are exposed.

5. The screen of claim 4, wherein said gas exhaust member additionally extends to said inner sidewall of said panel from the boundary of said metal layer, except for a region where said stud pin is positioned.

6. The screen of claim 1, wherein said gas exhaust member is formed as an extension of said metal layer to form a single body inside said panel.

7. The screen of claim 1, wherein said gas exhaust member is formed of an aluminum layer.

8. The screen of claim 1, said gas exhaust member being formed along the boundary of said metal layer in said inner front surface of said panel.

9. The screen of claim 1, said gas exhaust member additionally extending to said inner sidewall of said panel from the boundary of said metal layer.

10. The screen of claim 1, said gas exhaust member formed by a mask pattern of a guide block including a recession and projection portion.

11. The screen of claim 1, said gas exhaust member being deposited on said inner sidewall of said panel, extending up to a height of said stud pin.

12. The screen of claim 1, said gas exhaust member comprising:

a first gas exhaust member extending from said metal layer and protruding from a boundary of said metal layer, said first gas exhaust member selectively formed on the edge of said inner front surface of said panel; and a second gas exhaust member extending from said first gas exhaust member and formed along said inner sidewall of said panel, said second gas exhaust member not being formed adjacent to a region where said first gas exhaust member is not formed.

13. A screen for a cathode ray tube, comprising:

a phosphor film formed on an inner front surface of a panel where at least one stud pin is mounted, said phosphor film including phosphor layers;

a metal layer formed on said phosphor film, reflecting light emitted from said phosphor layers toward a front side of said panel; and a gas exhaust member extended from said metal layer, providing a path for gas to exhaust, the gas being generated as a filming layer, interposed between said phosphor film and said metal layer to make the thickness of said phosphor film uniform, is decomposed, wherein said gas exhaust member is formed along the boundary of said metal layer in said inner front surface of said panel, except for the corners of said panel.

14. The screen of claim 13, wherein said gas exhaust member additionally extends to said inner sidewall of said panel from the boundary of said metal layer, except for a region where said stud pin is positioned.

15. A screen for a cathode ray tube, comprising:

a phosphor film formed on an inner front surface of a panel where at least one stud pin is mounted, said phosphor film including phosphor layers;

a metal layer formed on said phosphor film, reflecting light emitted from said phosphor layers toward a front side of said panel; and a gas exhaust member extended from said metal layer, providing a path for gas to exhaust, the gas being generated as a filming layer, interposed between said phosphor film and said metal layer to make the thickness of said phosphor film uniform, is decomposed, wherein said gas exhaust member is formed along the boundary of said metal layer in said inner front surface of said panel, except for the side edges of said panel.

16. The screen of claim 15, wherein said gas exhaust member additionally extends to said inner sidewall of said panel from the boundary of said metal layer, except for a region where said stud pin is positioned.

17. A screen for a cathode ray tube, comprising:

a phosphor film comprising a plurality of phosphor layers, formed on an inner front surface of a panel;

a metal layer oriented to cover the phosphor film and to reflect light emitted by said phosphor layers; and a gas exhaust member disposed to accommodate passage of gas generated during decomposition of an organic material borne by said phosphor film, said exhaust member selectively extending from a boundary of said metal layer as a pattern, said gas exhaust member not being disposed at a long-side or short-side edge of said panel.

18. The screen of claim 17, with said gas exhaust member comprising:

a first gas exhaust member extending from said metal layer and protruding from a boundary of said metal layer, said first gas exhaust member selectively formed on the edge of said inner front surface of said panel; and a second gas exhaust member extending from said first gas exhaust member and formed along said inner sidewall of said panel, said second gas exhaust member not being formed adjacent to a region where said first gas exhaust member is not formed.

19. The screen of claim 17, with said gas exhaust member comprising at least one recession along side edges of said panel being exposed and no said metal layer on a portion of the edge of said inner front surface of said panel adjacent to said first gas exhaust member.

20. A screen for a cathode ray tube, comprising:

a phosphor film comprising a plurality of phosphor layers, formed on an inner front surface of a panel;

a metal layer oriented to cover the phosphor film and to reflect light emitted by said phosphor layers; and a gas exhaust member disposed to accommodate passage of gas generated during decomposition of an organic material borne by said phosphor film, said exhaust member selectively extending from a boundary of said metal layer as a pattern, with said gas exhaust member being not formed on the corners of said panel.

* * * * *